United States Patent [19]

Croteau

[11] Patent Number: 4,807,510

[45] Date of Patent: Feb. 28, 1989

[54] SUSPENDED MUSICAL IDIOPHONE

[76] Inventor: Stephen M. Croteau, 1528 East 38th, Spokane, Wash. 99203

[21] Appl. No.: 25,957

[22] Filed: Mar. 16, 1987

[51] Int. Cl.[4] ..... G10D 13/08

[52] U.S. Cl. ..... 84/402

[58] Field of Search ..... 84/402, 403, 406, 408, 84/409; 368/273; 116/148, 149, 150, 152, 168–172

[56] References Cited

U.S. PATENT DOCUMENTS

| | | | |
|---|---|---|---|
| 10,253 | 9/1854 | Sanford | 116/168 X |
| 258,609 | 6/1882 | Sanford | 116/168 |
| 279,022 | 5/1883 | Sanford | 116/168 |
| 439,193 | 10/1890 | Sanford | 116/168 |
| 453,067 | 9/1891 | Sanford | 116/168 |
| 557,040 | 3/1896 | Willcock | 116/168 |
| 922,021 | 6/1909 | Morgan | 116/148 |
| 2,189,095 | 2/1940 | Zildjian | 84/402 |
| 3,546,994 | 12/1970 | Paiste | 84/402 |
| 3,688,627 | 9/1972 | Peterson | 84/402 X |
| 4,114,502 | 9/1978 | Zildjian | 84/402 |
| 4,211,143 | 7/1980 | Cote | 84/402 |
| 4,320,687 | 3/1982 | Kidwell | 84/402 |

FOREIGN PATENT DOCUMENTS

| | | | |
|---|---|---|---|
| 3646 | of 1889 | United Kingdom | 116/168 |

*Primary Examiner*—L. T. Hix
*Assistant Examiner*—Brian W. Brown
*Attorney, Agent, or Firm*—Wells, St. John & Roberts

[57] ABSTRACT

A suspended idiophone is described in which a plate of sonorous material is formed along an axis in a manner by which the plate will be capable of expanding and contracting resiliently to produce an acoustical vibrato. The musical sound produced by the present idiophone will resemble that produced by a standard cymbal or gong with the addition of vibrato afforded through the particular configuration due to resiliency of material along an axis. When sounded, the resilient material will oscillate axially to produce the vibrato effect.

10 Claims, 2 Drawing Sheets

SUSPENDED MUSICAL IDIOPHONE

TECHNICAL FIELD

The present invention relates broadly to the field of idiophonic musical instruments and more particularly to such an instrument comprised of a suspended sonorous plate that is resilient along an axis and capable of producing a vibrato effect when sounded.

BACKGROUND OF THE INVENTION

An "idiophone" is a form of musical instrument that broadly includes nearly any sonorous or musical sound generating device that is sounded by stamping, striking, shaking, clapping together, scraping, rubbing, or plucking.

Many forms of idiophones may be sounded by using more than one combination of the above sound producing methods. The cymbal, for example, may be sounded by using the striking, clapping, and scraping procedures to produce different musical sounds. These sounds may also be varied according to the area of the cymbal upon which they are applied. For example, brushes used on a suspended cymbal can be effectively used to produce a sustained "swishing" sound as opposed to the sudden, bright crash that may be produced by striking the cymbal with a hard object such as a drumstick. Gongs have similar characteristics but are seldom used to produce sounds other than those generated by the striking procedure.

Even with the above variety of sound producing methods available with various idiophones, new and unusual musical sounds are constantly being sought out.

It remains desirable, for example, to maintain a cymbal or gong sound while distinguishing the sound with vibrato. Heretofore, "vibrato" has not easily been established, especially with cymbals and gongs. Vibrato may be achieved with bells by rotating a struck bar rapidly about a fixed axis. The rotational motion, coupled with the vibratory action of the struck material produces a vibrato effect that will vary in frequency with the speed of rotation. The vibrato will therefore slowly erode as rotation slows. It is a somewhat difficult matter to initiate the tone along with vibrato since the bar must be struck and then rotated to establish the vibrato effect. While this is not a difficult feat when attempted in isolation, it becomes extremely difficult to accomplish during a performance in which striking of the rotatable bar is merely one function in a multitude of others that must be preformed throughout the performance. Furthermore, restriking the bar becomes difficult once the bar is set in rotary motion. The striking action has an effect on the rotational speed and cannot be easily controlled to produce both the desired sound and vibrato.

Vibrato is more easily produced in instruments that lend themselves to use with resonating tubes, such as the vibraphone. With such instruments, mechanical apparatus may be provided to alternately open and close the resonating tubes such that the reinforcement of sound produced through the tubes is periodically interrupted with a characteristic vibrato sound resulting. Resonating tubes are not easily adapted to all idiophones, however, since the tubes will only operate when the vibration frequency of the air column within the resonating tube is the same as that of the sounded idiophone. Cymbals, for example, operate over a large band of frequencies and therefore do not easily lend themselves to use with a resonating tube. Nonetheless, even instruments where use with resonating tubes is feasible, the addition of mechanically rotatable vibrator producing apparatus is usually mechanically and economically impractical.

From the above, it may be understood that there remains a desire to obtain unique forms of idiophones that expand the number of various sounds that may be produced, yet that will include, as a capability, the ability to produce relatively conventional sounds. It is also evident, from the above, that there is a need remaining for an instrument that includes inherent vibrato capabilities.

BRIEF DESCRIPTION OF THE DRAWINGS

Preferred and alternate forms of the invention are illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Several versions of the present invention are illustrated in the accompanying drawings. The versions illustrated are given by way of example to indicate various forms in which the present invention may be constructed and utilized.

Generally speaking, all forms of the present invention include several important generic features. All forms of the present invention comprise a suspended idiophone 10 that is constructed of a sonorous material that is shaped, tempered, or otherwise configured to produce a desired musical noise when sounded.

The present idiophone also generally includes a plate of the sonorous material that is necessarily resilient along an axis. All forms of the present idiophone may be formed of a variety of sonorous materials. Examples of such materials are copper, bronze, brass, copper-tin alloys, and other materials that are typical and well known in the production of standard musical cymbals and gongs. Such materials can be formed and treated in such a manner as to have a desired resiliency when shaped as indicated by the examples discussed below.

Preferably, the material selected will produce a sustained, bright crash or atonal gong sound with vibrato imparted through the structure of the present invention.

A suspension means 11 is included that will permit free suspension of the idiophone in the atmosphere while enabling oscillational movement of the plate along the axis. The oscillational motion may be imparted by sounding the idiophone (as by striking the plate with a drumstick, mallet, or brush) or by forcibly moving the idiophone along the axis to initiate oscillations. Such oscillations, when produced, have the effect when the plate is sounded of producing a sustained musical noise when a vibrato coincidental with the resilient oscillations of the plate.

Figure 1:
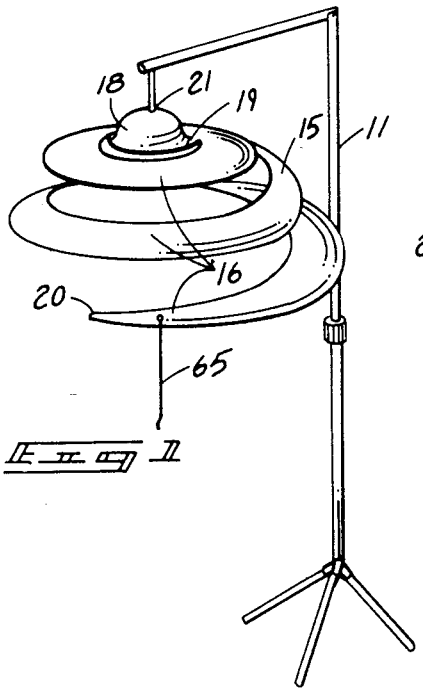
FIG. 1 is a pictorial view of a first preferred form of the present invention suspended from a support stand.
Figure 2:
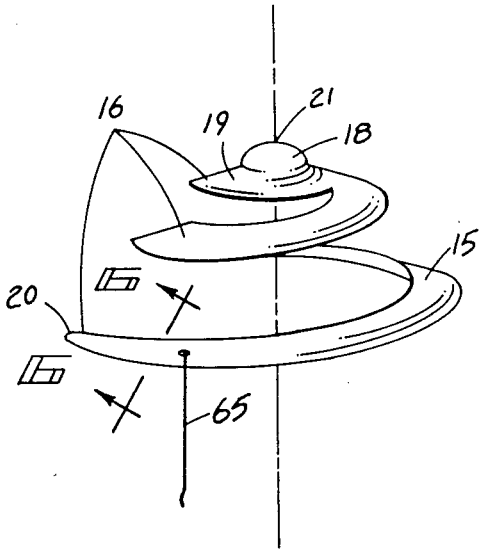
FIG. 2 is a side elevation view of the form shown in FIG. 1.
Figure 6:
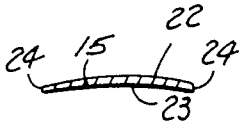
FIG. 6 is an enlarged sectional view taken substantially along 6—6 in FIG. 2.

More specifically, a preferred form of the present invention is illustrated in FIGS. 1, 2 and in a detailed sectional view in FIG. 6. The preferred form of the present invention consists of an elongated plate 15 that is formed in a substantially spiral configuration defining several individual, yet interconnected, flights 16 separated along a central axis. The flights extend down and outwardly from the central axis from an inward end 19 to an outward end 20. A bell 18 is advantageously provided at the inward end 19 and includes suspension means in the form of a central mounting hole 21 to which a standard suspension frame or support 11 can be secured.

FIG. 6 illustrates a sectional view through one of the flights 16 to clearly indicate a top surface 22 of the flight and an opposed bottom surface 23. FIG. 6 also clearly shows opposed side edges 24. These edges may be defined as parting lines that separate the overall substantially circular configuration of the preferred idiophone form into the spiral configuration shown.

The side edges 24 also define a thickness dimension between the surfaces 22, 23 as shown in FIG. 6. It is advantageous that the surfaces taper to at least one of the side edges 24. In FIG. 6, the thickness dimension is maximum at one side edge and tapers to a minimum at the opposide side edge. This is a configuration that is inherent from the forming process for this instrument as will be understood below.

The first preferred form of the present invention as described above may be formed from a single plate of sonorous material shaped and formed initially as a standard cymbal or gong. The present idiophone configuration may be derived from the initial disk configuration by initially utilizing standard musical cymbal forming techniques. The blank, in other words, would be pressed or stamped into a somewhat dome-shaped configuration. The shaped blank may then be turned, spun, and/or hammered to taper the material from a maximum thickness area adjacent the center to a minimum thickness at the circular rim. Individual machining operations may occur on both top and bottom surfaces in order to produce a gradual thinning of the material toward the outer peripheral edge. Next, a cutting operation may occur in which the flights 16 are formed. This operation may be performed by conventional metal or sheet metal cutting appliances with care taken not to deform the areas of the plate adjacent to the cut. The parting line or kerf is therefore formed in a spiral configuration decreasing uniformly in diameter from the circular perimeter of the cymbal or gong shaped blank toward the center.

The overall taper, increasing in thickness from the circular perimeter toward the center results in the flight thickness configuration exemplified by FIG. 6 of the drawings. The minimum thickness dimension will therefore exist at the outer edge of the flights and a maximum thickness at the inward edge (with respect to the center of the instrument).

Figure 3:
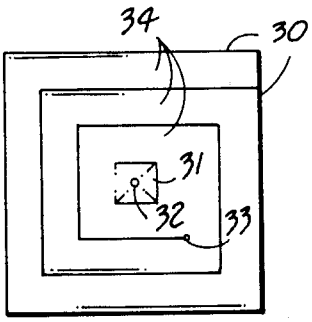
FIG. 3 is a top view of an alternate form of the present invention utilizing a square configuration.

The embodiment illustrated in FIG. 3 is provided to show a variation of the present idiophone construction. The FIG. 3 embodiment includes rectilinear side edges 30 as opposed to the arcuate peripheral edges for the preferred form described above. The center portion of the substantially square instrument may include a similarly configurated bell 31. The bell 31, like bell 18, may be formed by pressing or stamping the sonorous material at the plate center into a convex configuration. The bell 31, if used in the FIG. 3 version, may take a similar configuration with respect to the peripheral plate configuration, or alternatively may be rounded as the bell configuration shown in FIGS. 1 and 2. The bell 31 preferably includes a center hole 32 provided as means for suspension of the instrument.

The parting line in the FIG. 3 configuration follows the general peripheral configuration of the instrument, leading inward along lines parallel to the respective side edges of the perimeter so the flights 34 formed thereby are of substantially equal width dimensions. The parting line terminates adjacent the center hole 32 and bell 31 at a small aperture 33. The aperture 33 is provided in this form and may be included in other forms for the purpose of "stopping" the parting line and thereby preventing tearing of the plate material at the termination point for the parting line.

Construction of the FIG. 3 embodiment may proceed in a manner substantially similar to that disclosed for the embodiment shown in FIGS. 1 and 2.

Figure 4:
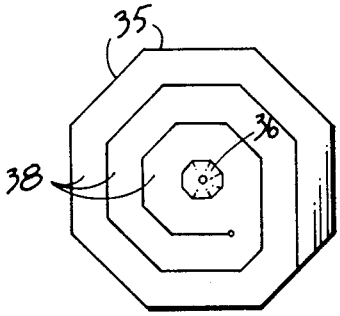
FIG. 4 is a top plan view illustrative of another polygonal form for the present idiophone.

Another configuration is illustrated in FIG. 4 in which the peripheral configuration of the instrument is octagonal. This figure demonstrates the further ability for the present idiophone to be produced in a variety of configurations. Here, the instrument may include octagonal side edges 35 and a similarly shaped bell configuration 36. The parting line forming the flights 38 extends parallel to the successive side edges in ever decreasing distances from the center to produce a rectilinear spiral configuration conforming to the outward octagonal perimeter configuration.

The configurations illustrated in FIGS. 1 through 4 are substantially consistent with one another with the exception that the perimeter configuration varies and the parting line is made to conform substantially with the edges formed along the perimeter. It is well understood that other configurations may be easily envisioned using the teachings of the examples identified herein.

Figure 5:
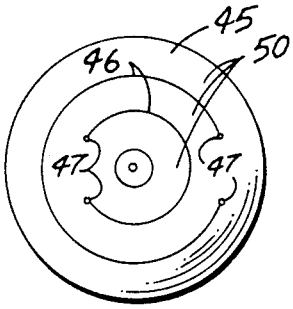
FIG. 5 is a top plan view of yet another form of the present idiophone.

FIG. 5 is illustrative of another preferred form of the present invention. FIG. 5, like FIGS. 3 and 4, is a top plan view to illustrate the extend perimeter of the instrument and the configuration of the parting lines. The FIG. 5 version may be formed, for example, as a circular plate 45 with concentric semi-circular parting lines 46. The parting lines 46 are advantageously formed on radii from the center of the circular plate to form flights 50 of substantially equal widths. It is preferred that the parting lines 46 to be formed on radii, but it is understood that other configurations for the parting lines may be utilized as well as the plate configuration, so long as the parting lines extend substantially about the central area of the plate 45 to facilitate axial resilient separation of the individual flights 50. The parting lines perferably terminate in holes 47 that are placed at the parting line ends in order to avoid ripping of the material. The holes 47 are spaced apart from one another by distances so the individual flights will separate angularly from one another along an axis passing through the plate when the plate is suspeneded and so the flights will be capable of oscillation resiliently along the axis in a desired manner.

Construction of the FIG. 5 configuration may be performed also utilizing conventional metal cutting techniques following a procedure in which a relatively standard cymbal or gong form is produced. Once the standard cymbal or gong configuration is derived, the parting lines 46 may be added to define the individual flights 50 and to allow axial gravitational separation of the flights as required to enable resilient axial oscillations of the instrument when sounded.

Figure 7:
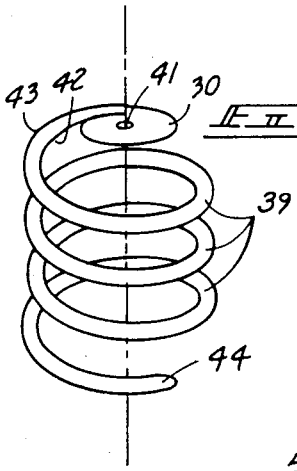
FIG. 7 is a side elevation view of a helical form of the present idiophone in which the flights remain at a fixed radii from a center axis.

FIG. 7 exemplifies a somewhat different configuration in that the resilient flights 39 of this version are formed as a helix along a central axis. The flights 39 of this version remain on a relatively constant radius from the center axis, but are spaced along the axis to form the helical configuration. The flights extend from a top end 40 which may include a hole 41 for suspending the instrument to a bottom end 44. The resilient helical flights extending between ends 40 and 44 include an inward edge 42 that remains substantially equidistant from the center axis and outward edge 43 that is also equidistant from the center axis but spaced outward of the edge 42. Distance between the inward and outward edges define the width dimension of the flights which may vary, as do standard cymbal or gong diameters, for purposes and deriving different desired acoustical qualities.

The instrument in the FIG. 7 version may be formed of a single thin elongated strip of sonorous material that may be formed into the resilient helical flights by hot rolling or by other appropriate forming techniques. In this embodiment, there may not be a "parting line" as suggested in the FIGS. 1 through 4 configurations since the instrument is not necessarily cut from a plate of material. However, the flights are similarly oriented with respect to a center axis and the quality of the sonorous material will be similar. The material is selected and formed so the flights may be made to resilient expand and contract axially when sounded to produce a musical "noise" with vibrato corresponding to the axial oscillations of the flights.

Figure 8:
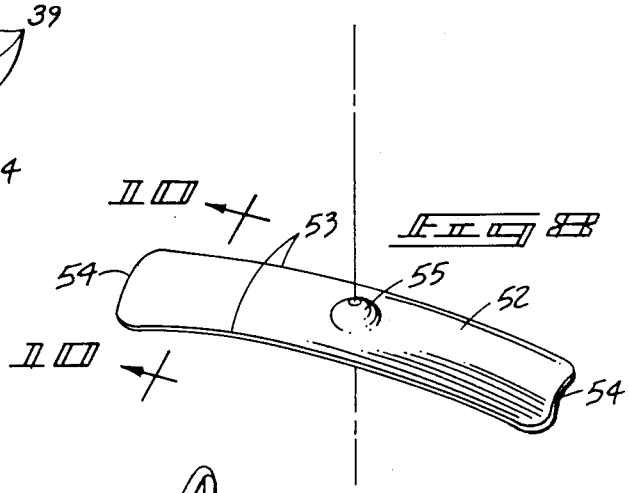
FIG. 8 is a perspective view of a still further form of the present invention.
Figure 9:
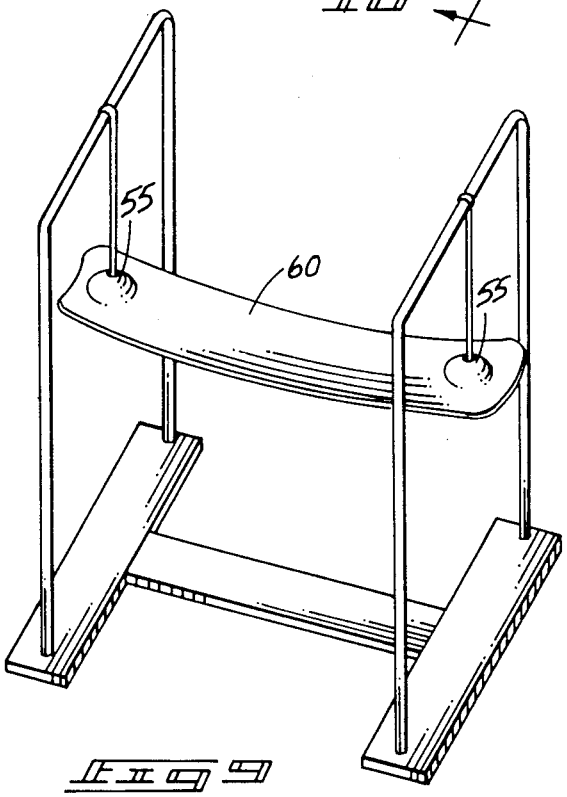
FIG. 9 is a view of a form similar to that shown in FIG. 8 with a modified suspension arrangement.

FIGS. 8 and 9 illustrate an embodiment of the present invention utilizing a substantially elongated, rectangular plate 52. This plate includes longitudinal side edges 53 and transverse ends 54. The plate is formed of a relatively thin sonorous material such as the alloys typically utilized for construction of cymbals or gongs and is produced at a dimension that will enable resilient oscillation of the plate along its length and along an axis passing through the plate and substantially perpendicular to a surface thereof. When sounded, the plate will oscillate axially to produce a vibrato effect in a manner similar to the effect produced with the embodiments disclosed above. The frequency of the vibrato will vary with the length of the plate and resilience of the material.

The configurations shown in FIG. 9 exemplifies a variation in the suspension means where the elongated plate 60 is suspended adjacent its ends. Here, suspension may, for example, be achieved by securing the opposed ends of the elongated plate to individual end supports. Vibrato would therefore be effected by oscillation of the central areas of the plate along the axis, unlike the FIG. 8 embodiment where similar vibrato would occur at the plate ends 54. Both forms of the plate may, if desired, include a bell or bells 55 at the suspension means.

Figure 10:
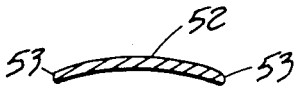
FIG. 10 is an enlarged sectional view taken substantially along line 10—10 in FIG. 8.

FIG. 10 illustrates a tapered cross-sectional configuration for the plate. Here, unlike FIG. 7, the taper leadds from a major thickness dimension at the center of the plate to opposite side edges 53. A similar taper may be provided longitudinally with a major thickness dimension at the center (in the FIG. 8 configuration) tapering to a minimal thickness dimension at the ends 54. The tapering indicated for the FIG. 8 version may be substantially reversed for the verion shown in FIG. 9 due to the suspension means being located adjacent the plate ends. In other words, it may be that the taper would run from maximum thicknesses at the plate ends toward minimal thickness at the plate center to better effect resilience of the plate at the center, and thereby promote resilient oscillation along the axis in this area.

Figure 11:
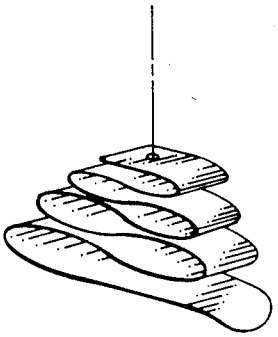
FIG. 11 is a pictorial view of serpentine configuratoin for the present idiophone.

The configuration illustrated in FIG. 11 may be produced by substantially folding or bending an elongated plate successively upon itself. The plate configuration may be similar to that shown in FIGS. 8 and 9 with the exception of the mounting means or suspension means which may be located at one of the plate ends. This configuration provides for a more compact arrangement with similar resilient oscillation capabilities.

It is pointed out that other variations may be envisioned from the disclosure made above. For example, the suspension means may be situated other than as indicated at the approximate center or along the axis of oscillation for the instrument. The suspension means could be placed along the length of the spiral or helical flights, for example, to enable opposite ends of the flight configuratoins to hang on opposite sides of a suspension cord or like device. The instrument would therefore be suspended in a manner somewhat similar to the suspension of a gong. It is preferable, however, to utilize the suspension along the axis of resilient oscillation to provide a balance for the instrument and to simply suspension apparatus and minimize space requirements.

Operation of the present idiophone is accomplished simply by suspending the idiophone in an appropriate frame such as the stand generally illustrated in FIG. 1 and by sounding the idiophone as by striking it with a drumstick, mallet, brush, etc. Different effects may be produced by striking the instrument in different areas and with different striking implements.

The vibrato produced may also be varied by varying the degree of oscillation for the instrument along the central axis. These oscillations may be put into effect either simultaneously with the striking motion or can be supplemented by physically expanding or contracting the instrument along the axis. The vibrato effect normally produced by the oscillations will be sustained due to the inherent resiliency of the material and the configuration of the instrument. A control 65 may be provided as shown in FIG. 1 (and equally adapted to any of the other conceivable versions) to facilate manual initiation of the vibrato or to enable the musician to dampen or stop the vibrato effect. The control can be comprised of a free hanging string or cord simply attached through an aperture in the instrument.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A suspended idiophone, comprising:

an elongated resilient plate formed of a sonorous material and having suspension means thereon for facilitating free suspension of the plate from a support;

an axis passing through the plate; and wherein the plate is formed along the length thereof in a series of flights that depend from the suspension means and that are resiliently expandable and contractible relative to one another along the axis to produce a musical sound with a vibrato effect responsive to sounding of the plate.

2. The idiophone of claim 1 wherein the plate is formed in a spiral configuration with the flights winding about the axis.

3. The idiophone of claim 2 wherein the spiral configuration includes a central inward end; and wherein the suspension means is situated at the central inward end for suspending the plate.

4. The idiophone of claim 1 wherein the plate is formed in a sprial configuration with the flights winding about the axis in progressively increasing distances therefrom.

5. The idiophone of claim 1 wherein the plate is substantially circular.

6. The idiophone of claim 1 further comprising a dome shaped bell along the plate and wherein the suspension means is comprised of a suspension aperture through the bell.

7. A suspended idiophone, comprising:

substantialy flat elongated plate of a resilient sonorous material;

suspension means on the plate facilitating hanging of the plate for relatively sustained vibration producing a muscial sound when struck;

means forming the plate with respect to the suspension means for resilient oscillation along an axis passing through the plate for producing a vibrato effect on the musical sound produced with the plate is struck;

wherein the elongated plate includes a thickness dimension between top and bottom surfaces and wherein the plate also includes elongated side edges joined at plate ends by plate end edges; and wherein the thickness dimension diminishes toward at least one of the edges.

8. The suspended idiophone of claim 7 wherein the means forming the plate is comprised of a spiral configuration formed along the length of the plate and defining a plurality of integral flights that are movable resiliently along the axis.

9. The suspended idiophone of claim 7 further comprising a bell formed in the plate along the length thereof; and wherein the suspension means is located on the bell.

10. The suspended idiophone of claim 5 wherein the plate includes a substantially flat surface and the axis passing through the plate is substantially perpendicular to the flat surface;

wherein the plate is formed in an elongated substantially rectangular strip with the suspension means arranged along the length thereof to enable axial oscillation of the plate along the axis passing through plate.

* * * * *